US011588272B2

(12) United States Patent
Gilbert et al.

(10) Patent No.: US 11,588,272 B2
(45) Date of Patent: Feb. 21, 2023

(54) CONNECTION ASSEMBLY WITH RAPID AND SECURE FASTENING

(71) Applicant: AXON CABLE, Montmirail (FR)

(72) Inventors: Erwan Gilbert, Montmirail (FR); Benoît Bartkowiak, Montmirail (FR); Stéphane Andre, Montmirail (FR)

( * ) Notice: Subject to any disclaimer, the term of this patent is extended or adjusted under 35 U.S.C. 154(b) by 0 days.

(21) Appl. No.: 17/198,279

(22) Filed: Mar. 11, 2021

(65) Prior Publication Data

US 2021/0288437 A1 Sep. 16, 2021

(30) Foreign Application Priority Data

Mar. 11, 2020 (FR) ..... 20 02402

(51) Int. Cl.

| | |
|---|---|
| ***H01R 13/625*** | (2006.01) |
| ***H01R 13/621*** | (2006.01) |
| ***H01R 13/631*** | (2006.01) |
| *H01R 13/639* | (2006.01) |

(52) U.S. Cl.

CPC ..... *H01R 13/621* (2013.01); *H01R 13/631* (2013.01); *H01R 13/639* (2013.01)

(58) Field of Classification Search

CPC ... H01R 13/621; H01R 13/631; H01R 13/639
USPC ..... 439/345
See application file for complete search history.

(56) References Cited

U.S. PATENT DOCUMENTS 3,374,979 A 3/1968 Coldren
4,834,487 A * 5/1989 Abendschein ..... G02B 6/4478 385/75
5,031,981 A * 7/1991 Peterson ..... G02B 6/3897 81/176.15
5,363,459 A * 11/1994 Hultermans ..... G02B 6/3869 385/86
5,620,329 A * 4/1997 Kidd ..... H01R 13/6315 439/378

(Continued)

FOREIGN PATENT DOCUMENTS

| | | |
|---|---|---|
| FR | 1504285 A | 12/1967 |
| NL | 1022227 C2 | 6/2004 |

OTHER PUBLICATIONS

English language abstract of NL1022227.

*Primary Examiner* — Abdullah A Riyami
*Assistant Examiner* — Vladimir Imas
(74) *Attorney, Agent, or Firm* — Brian Gordaychik

(57) ABSTRACT

A connection assembly including a first connector comprising a post, and a second connector.

A body of the second connector comprises a fastening passage. The post can penetrate into said fastening passage by moving in a fastening direction, so as to reach a fastening position. In the fastening position, the post cannot move in a disassembly direction opposite to the fastening direction. The connectors are configured in such a manner that an external action applied solely to the post allows the post to pass from the fastening position to a free position, in which the post can move in translation in the disassembly direction.

In fastening position, the post is in a predetermined angular range. The connection assembly further comprises angular returning means to return the post into said predetermined angular range relative to the axis of the post, when the post is fastened to a body of the first connector.

14 Claims, 8 Drawing Sheets

(56) References Cited

U.S. PATENT DOCUMENTS 5,730,605 A * 3/1998 Glusker ..... H05K 7/1454 439/372
6,007,364 A * 12/1999 Wu ..... H01R 13/6315 439/378
6,007,375 A * 12/1999 Mackowiak ..... H01R 13/743 439/571
6,065,992 A * 5/2000 Wu ..... H01R 13/629 439/378
6,151,432 A * 11/2000 Nakajima ..... G02B 6/38875 385/60
6,261,122 B1 * 7/2001 Richter ..... H01R 13/6315 439/477
6,322,389 B1 * 11/2001 Reese ..... H01R 13/6315 439/553
6,835,076 B2 * 12/2004 Jones ..... H01R 13/4534 439/145
7,789,719 B1 * 9/2010 Yin ..... H01R 13/2421 439/700
8,011,946 B2 * 9/2011 Chen ..... H01R 13/62 439/345
8,360,796 B2 * 1/2013 Daubigney ..... H01R 13/639 439/378
8,449,314 B1 5/2013 Feist et al.
8,636,527 B2 * 1/2014 Hengel ..... H01R 13/6315 439/378
9,160,450 B2 * 10/2015 Duis ..... H04B 10/40
9,680,248 B1 * 6/2017 Chen ..... H01R 13/436
10,033,139 B2 * 7/2018 Sinton ..... H01R 13/639
10,181,677 B2 * 1/2019 Vassgård ..... H01R 13/629
10,498,067 B2 * 12/2019 Gilbert ..... G02B 6/3878
11,158,966 B2 * 10/2021 Gingrich, III ..... H05K 7/1454
2002/0173195 A1 11/2002 Burger
2005/0239317 A1 * 10/2005 Margulis ..... H01R 12/712 439/378
2006/0030196 A1 * 2/2006 Sasame ..... H01R 13/629 439/378
2006/0079113 A1 * 4/2006 Minich ..... H01R 12/716 439/378
2007/0037434 A1 * 2/2007 Fedder ..... H01R 12/7005 439/378
2008/0297988 A1 * 12/2008 Chau ..... H01R 13/426 361/741
2011/0008992 A1 * 1/2011 Alguera ..... B62D 53/125 439/378
2011/0159720 A1 * 6/2011 Chen ..... H01R 13/62 439/345
2011/0256753 A1 * 10/2011 Gulla ..... H01R 13/6453 439/378
2013/0034986 A1 2/2013 Cheng
2020/0144745 A1 * 5/2020 Lorenzo ..... H05K 5/0069
2021/0066853 A1 * 3/2021 Miller ..... H01R 24/66
2021/0344146 A1 * 11/2021 Chen ..... H01R 24/40
2022/0077639 A1 * 3/2022 Miller ..... H01R 13/6315

* cited by examiner

[Fig. 1]
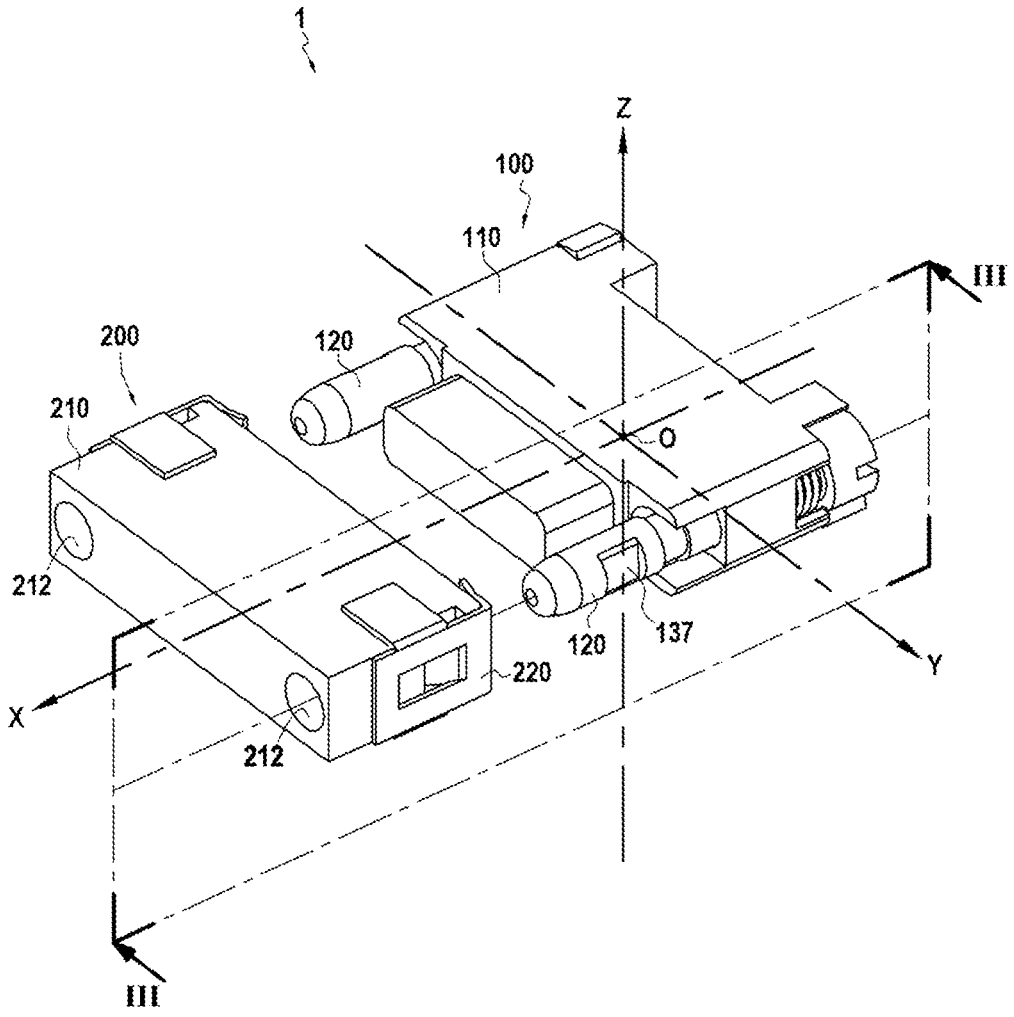

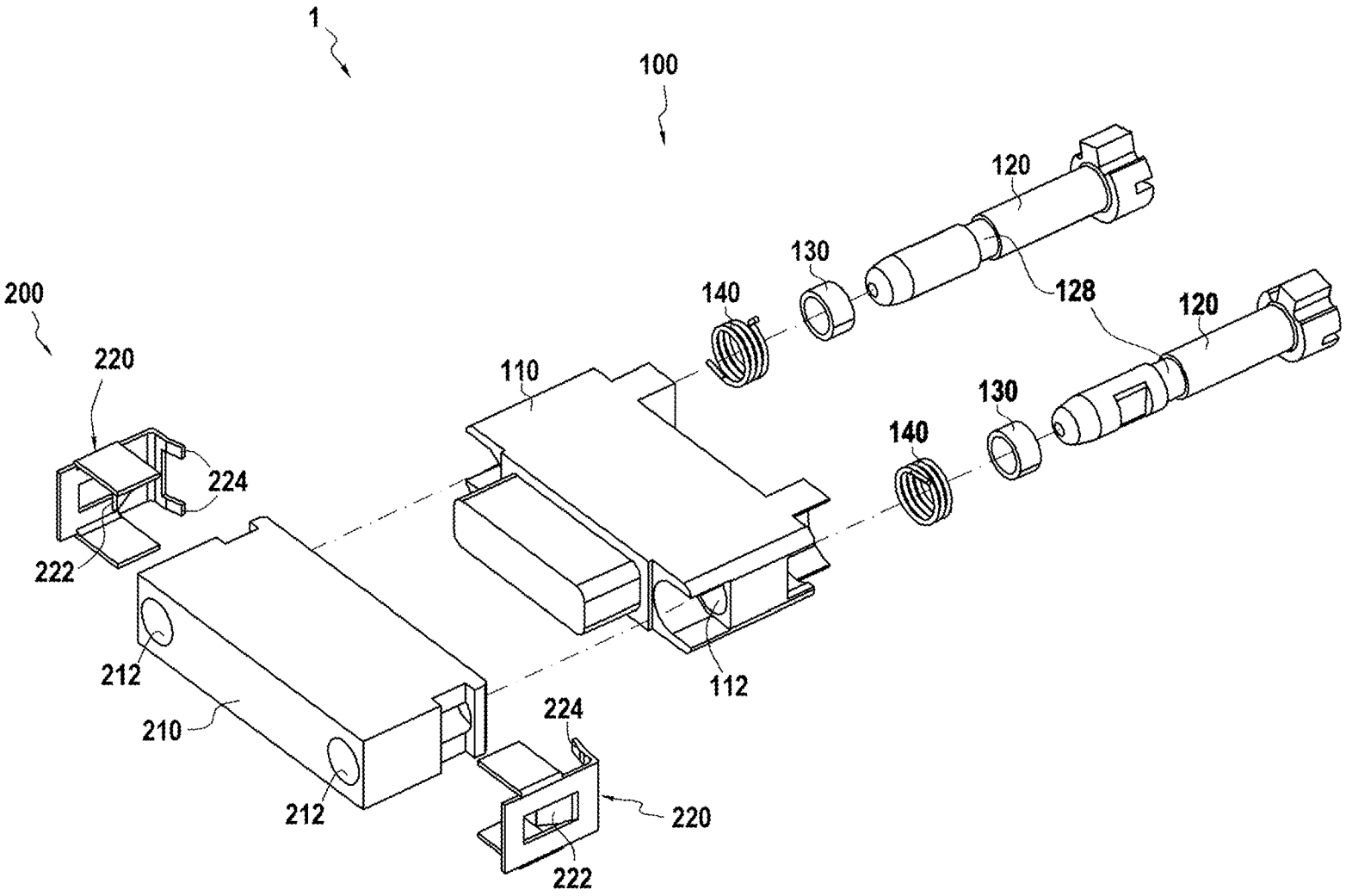
[Fig. 2]

[Fig. 3]
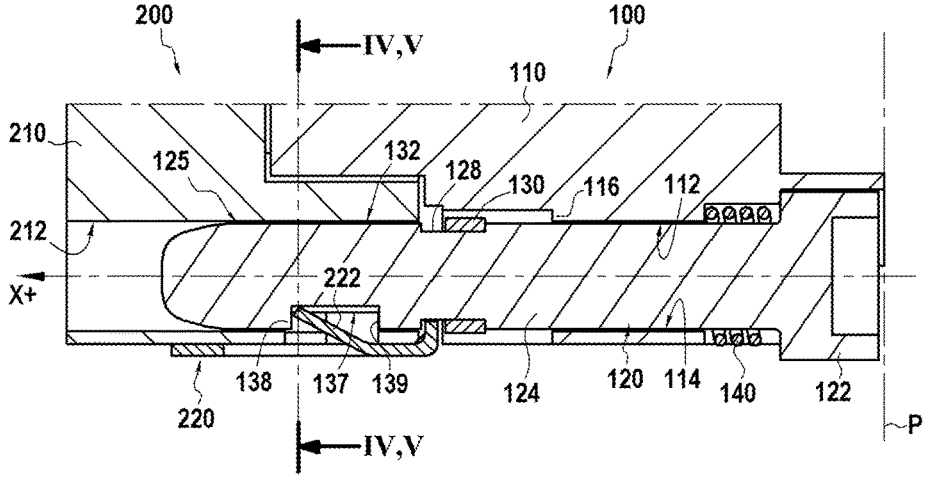
[Fig. 4]
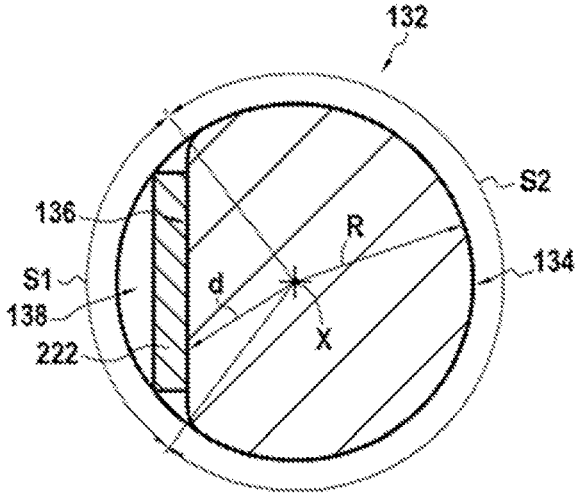
[Fig. 5]
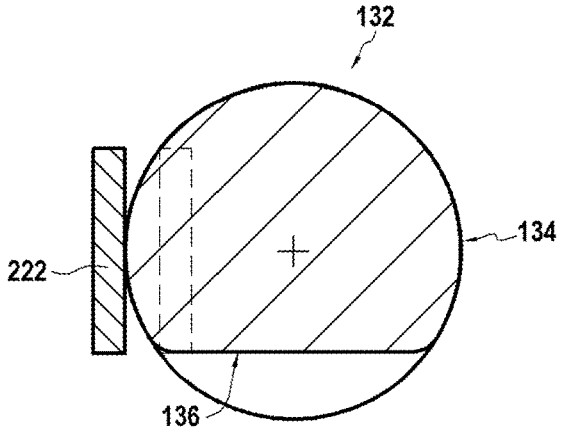

[Fig. 6]
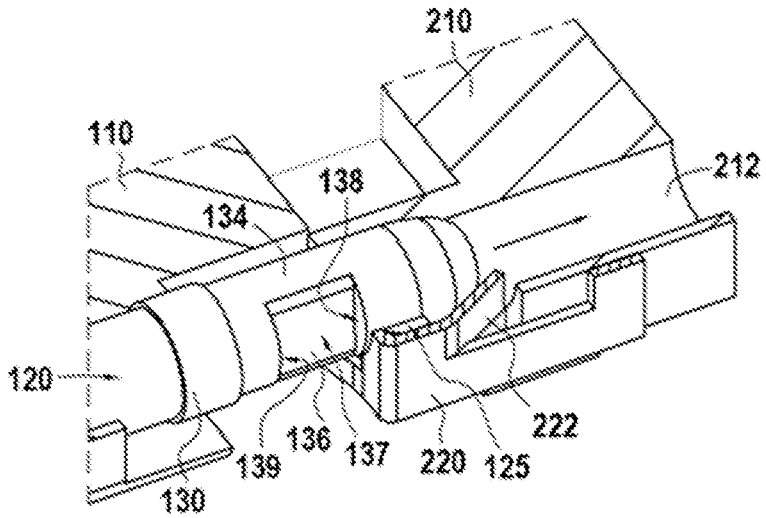
[Fig. 7]
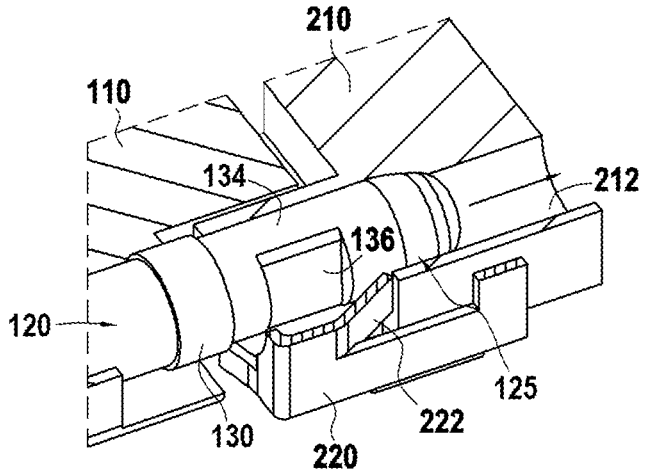

[Fig. 8]
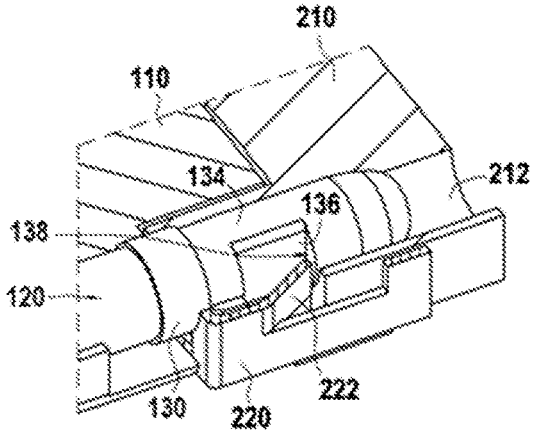
[Fig. 9]
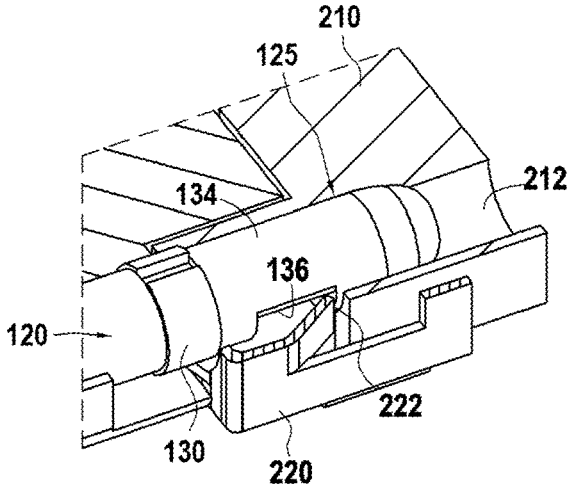
[Fig. 10]
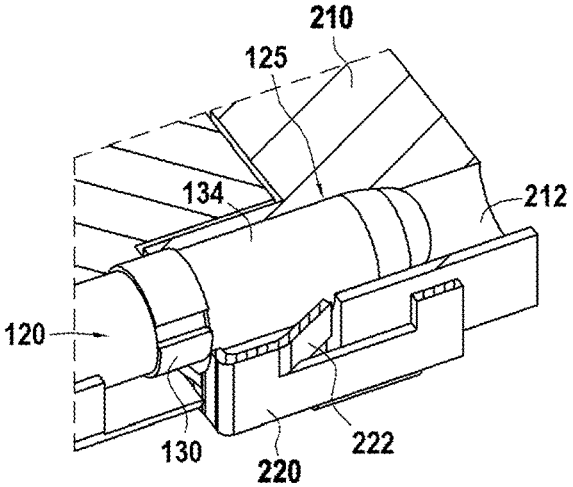

[Fig. 11]
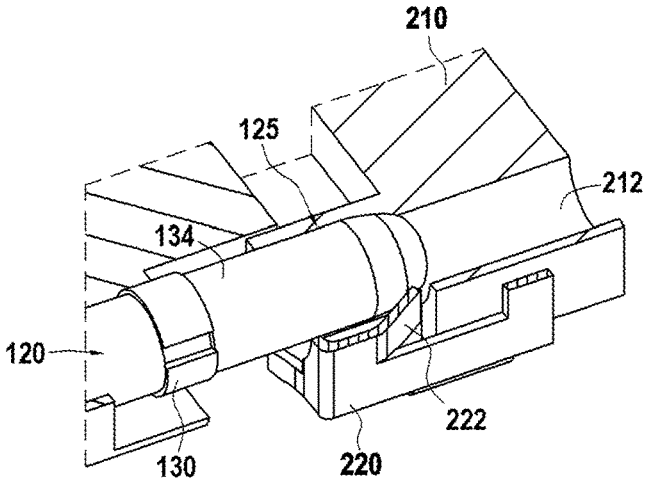
[Fig. 12]
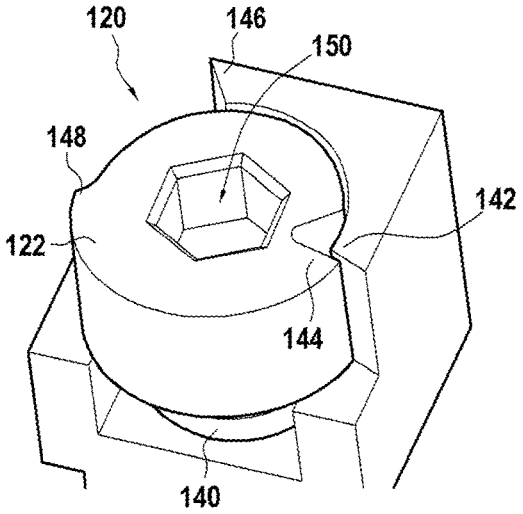
[Fig. 13]
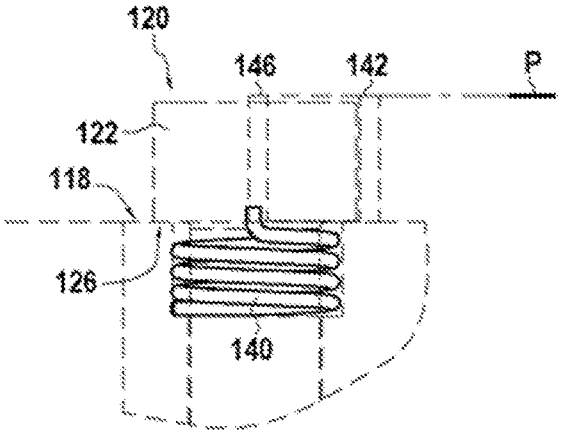

[Fig. 14]
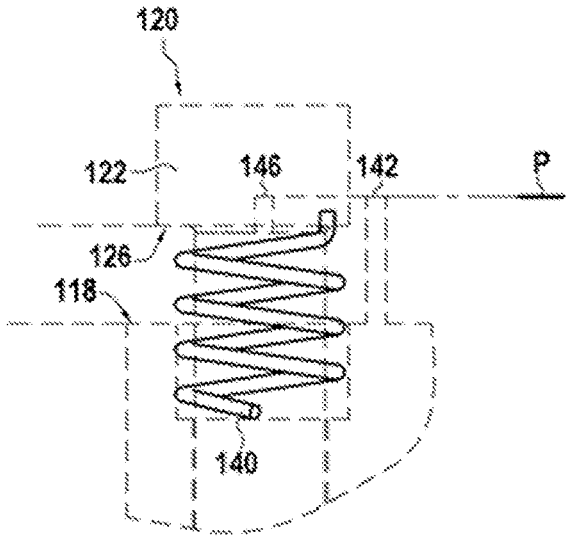
[Fig. 15]
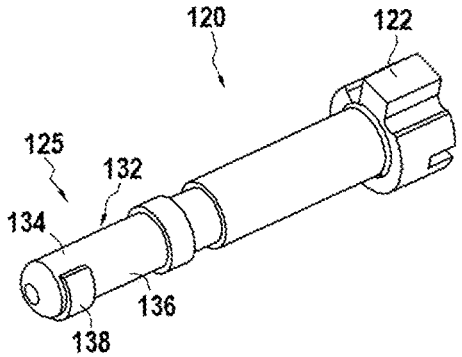
[Fig. 16]
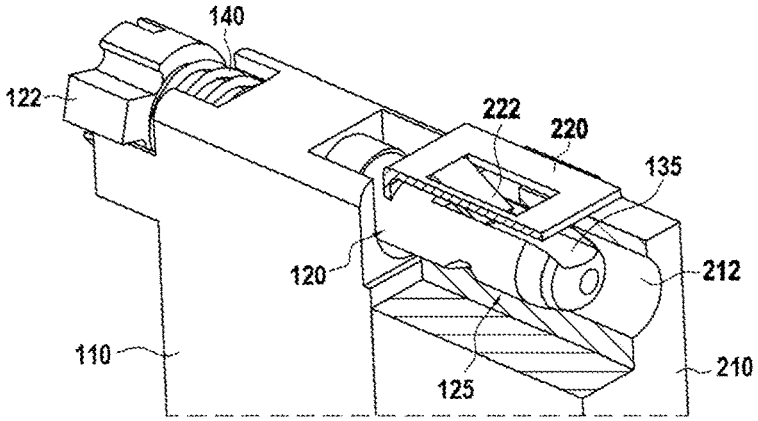

[Fig. 17]
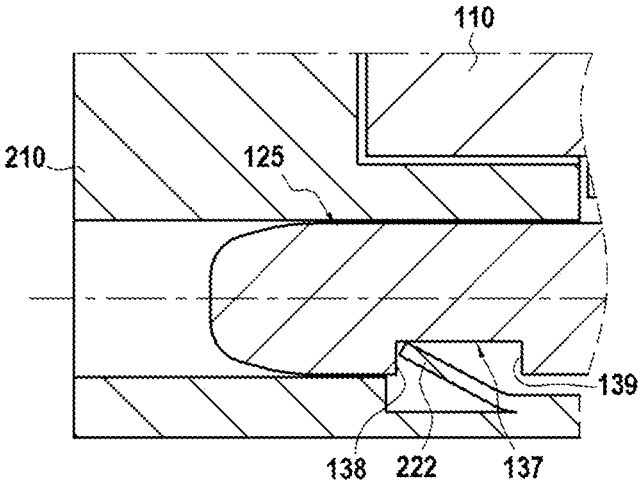
[Fig. 18]
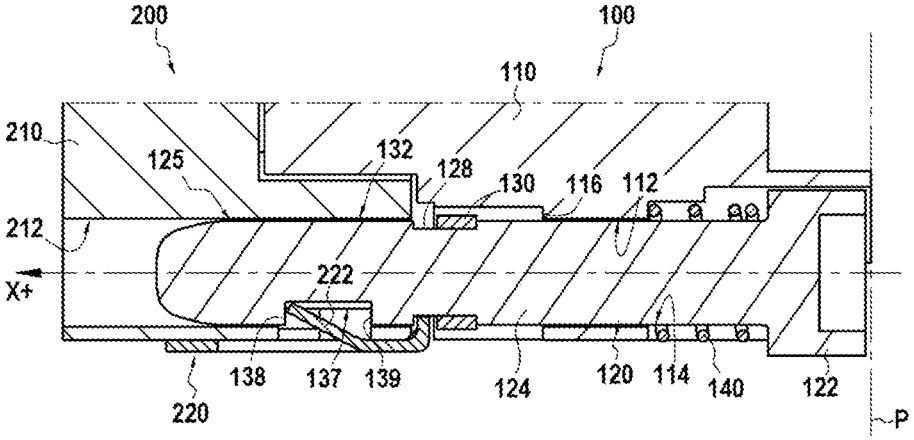

CONNECTION ASSEMBLY WITH RAPID AND SECURE FASTENING

FIELD

The present disclosure relates to the field of connection assemblies. Here a connection assembly designates a first connector and a second connector which must be attached to one another. These connectors are normally provided to connect cables or at least communication circuits together, in order to allow the exchange of information between first circuits connected to the first connector and second circuits connected to the second connector.

The present disclosure relates more precisely to the connection assemblies which must be miniaturized, the space available for connecting and disconnecting the connectors being very small. It therefore relates in particular to connection assemblies provided to satisfy the MIL-DTL-32139 standard (the format usually called "nano-D").

BACKGROUND

To satisfy the constraints indicated above, connection assemblies of known types include a first connector and a second connector, which are fastened to one another in the fastening position by means of screws. The screws ensure reliable and proven fastening; however, the connection and disconnection operations are long, a tightening operation and a predetermined torque being necessary, and can be difficult if only a little space for screwing and unscrewing of the screws is available.

A known alternative proposed by U.S. Pat. No. 8,449,314 consists of connection assemblies the connectors of which are attached to one another in the fastening position by means of fastening hooks. These hooks are fastened to the second connector by means of counterbores machined in its sides. This fastening mode has satisfactory reliability; however, the use of hooks can cause problems if the space available for the connection and disconnection operations is very small.

Thus there exists a need for connection assemblies able to ensure a reliable connection, but the connectors of which can be connected and disconnected in a simple and rapid manner, and in a very small volume.

SUMMARY

To satisfy this need, the following connection assembly is proposed.

According to a first aspect, this connection assembly includes a first connector and a second connector. The first connector comprises a post having an axis. A body of the second connector comprises a fastening passage for the post, and is arranged to allow the post to penetrate into said fastening passage by moving forward in a fastening direction, until it reaches a fastening position. The first connector and the second connector are configured in such manner that in the fastening position, the post is prevented by an abutment device from moving in a disassembly direction, which is a direction opposite to the fastening direction. The first connector and the second connector are configured in such a manner that an external action applied solely to the post allows the post to pass from the fastening position to a free position, in which the post is disengaged from the abutment device and can move in translation in the disassembly direction. In the fastening position, the post is in a predetermined angular range. The connection assembly further comprises angular returning means, comprising for example a spring, configured to return the post into said predetermined angular range relative to the axis of the post, when the post is fastened to a body of the first connector before it is fastened to the second connector.

In the present document, the term "post" designates any part (or assembly of parts) including an elongated portion able to be placed in a bore of corresponding shape.

In the present document, the term "direction" means a direction as defined by a straight line or a set of parallel straight lines. A direction can possibly have an orientation, depending on the context.

Generally, in the fastening position, the post passes in a guide passage arranged in a body of the first connector, and its end is placed in the fastening passage of the second body. Consequently, in the fastening position, the post insures alignment of the body of the first connector relative to the body of the second connector. However, more generally, the alignment of the body of the first connector with the body of the second connector can be ensured by any means.

The connection assembly presented above can naturally include more than one post for the fastening of the two connectors to one another. Each post can have all or part of the features and the functions indicated for the post presented here. For example, one or more of the posts can be only axial guide posts, provided to contribute to the holding of the alignment of the first connector with the second connector in the fastening position, but which don't have the function of holding the first connector in axial position with respect to the connector.

The connection assembly may be configured so that the connection of the post occurs automatically during the placement of the post (by a displacement in translation) in the fastening passage. This means that, during this movement, the abutment device preventing the post from moving in the reverse direction, in the disassembly direction, is set into place without external action and provides its retention function.

In different embodiments (which can be combined with one another provided that they are technically compatible), the connection assembly can have all or part of the following additional features:

According to a second aspect, in some embodiments, the external action includes (and advantageously can solely include) the application of a torque allowing, when the post is in the fastening position, to cause it to turn around its axis, and thus to cause it to pass from a fastening angular position until a free angular position different from the fastening angular position. In this free angular position, the post is in the free position. In this embodiment, the post can occupy or not the same axial position, in the fastening position and in the free position.

According to a third aspect, in some embodiments, one end of the post has a circumferential surface; in a first angular sector, the circumferential surface has a recessed surface delimited in front in the fastening direction by a first shoulder, the recessed surface being positioned radially recessed relative to the first shoulder; the abutment device includes a retaining tab secured axially to the second connector; and the first and the second connector are configured in such a manner that, when the post is in the fastening position, the retaining tab is positioned radially in front of the recessed surface, and is held in front of the first shoulder, when viewed in the fastening direction.

In this embodiment, when the post is in the fastening position, due to the fact that the retaining tab is held in front of the first shoulder (viewed in the fastening direction), any movement of the first shoulder in the disassembly direction is blocked by the retaining tab. Consequently, in this situation the post cannot move in the disassembly direction.

The connection assembly can thus comprise holding means configured to, when the post is in the fastening position, hold the retaining tab in front of first shoulder in the fastening direction (i.e., viewed in the fastening direction, the first shoulder is aligned with the retaining tab; while furthermore being axially positioned ahead of it).

In one variant of this embodiment, the recessed surface is delimited at the back in the fastening direction by a second shoulder. The recessed surface is positioned radially recessed relative to the second shoulder. The external action, in this embodiment, can thus include an axial thrust which displaces the post in the fastening direction. The first and the second connector are configured in such a manner that, when under the influence of this axial thrust, the post moves in the fastening direction, the second shoulder moves until it is axially at the retaining tab, radially driving back the retaining tab toward the outside.

According to a fourth aspect, in some embodiments, in a second angular sector, the circumferential surface has a disassembly surface having no shoulder in the fastening direction; and the first and the second connector are configured in such a manner that, when the post is in the free position, the retaining tab is positioned radially (i.e. viewed in a radial direction) in front of the disassembly surface.

In this embodiment, the fact that "the disassembly surface has no shoulder in the fastening direction" means that the disassembly surface is a surface that has no protrusion or step or any other relief feature able to block a retaining tab moving on the disassembly surface while remaining in contact with it from the fastening position until the post has entirely departed from the fastening passage.

In this embodiment, in the free position, as the retaining tab is positioned radially in front of the disassembly surface, it is not blocked by a shoulder with respect to a movement in the disassembly direction and can therefore move in the disassembly direction, which therefore allow moving the post in the disassembly direction and thus disconnecting the two connectors from one another.

The retaining tab, or retaining claw is a part or an assembly of parts of any shape. Moreover, the second connector can possibly include not a single tab but a plurality of retaining tabs, each having all or part of the features previously indicated.

According to a fifth aspect, in some embodiments, the retaining tab is formed integrally with the body of the second connector, or can be a portion of a retaining part fastened to the body of the second connector, said retaining part may be a strip portion.

According to a sixth aspect, in some embodiments, the connection assembly comprises tab returning means (or biasing means), particularly elastic returning (elastic biasing), configured to, in the absence of the post, hold the retaining tab in the fastening passage, at the same radial position as the shoulder of the post (viewed in the fastening direction). Thus, when the tab is place in this radial position and the post is in the fastening position, it blocks the axial movement of the first shoulder of the post, and thus prevents the post from being removed from the passage.

In this case, the connection assembly may be configured so that the connection of the post is accomplished simply by moving the post (in translation) in the fastening passage. During this movement, the retaining tab engages on its own against the shoulder of the post, thus ensuring its axial fastening.

The connection assembly is configured so as to allow movement of the post from a disassembled position in which the post is at a distance from the second connector, until the fastening position.

In certain embodiments, during the movement of the retaining tab (which is therefore, in the absence of the post, positioned in the fastening passage due to the tab returning means) is driven back radially toward the outside by the shoulder during the placement of the post in the fastening passage, then is replaced radially toward the interior in front of the recessed surface when the shoulder has moved forward beyond the retaining tab.

According to a seventh aspect, in some embodiments, in which the retaining tab is a portion of a retaining part fastened to the body of the second connector, the tab returning means includes the retaining part, the retaining tab being formed integrally with the retaining part.

According to an eighth aspect, in some embodiments, the first connector comprises an angular abutment, and the post comprises an angular abutment, said angular abutments being configured to come into contact when the angular returning means return the post into said predetermined angular range. The post is then place in the fastening angular position, i.e. the angular position which allows, during the connection of the first connector to the second connector, the recessed surface to be directly placed radially facing the retaining tab. The angular returning means can for example comprise a torsion spring, helical for example.

The first and the second connector may be configured in such a manner that the post is able to pass from the free position to a disengaged position in which the post is placed more to the rear than in the fastening position, and in which the second connector allows the departure of the post out of its fastening passage, regardless of the angular position of the post.

Thus according to a ninth aspect, in some embodiments, the first connector includes axial returning means (axial biasing means) such as a spring configured, when the post is in the free position, to move the post in the disassembly direction until a disengaged position in which the post, relative to a body of the first connector, is placed behind its axial position in the fastening position, and in which the second connector allows the departure of the post out of its fastening passage, regardless of the angular position of the post.

The connectors may be configured so that the difference in axial position of the post between the free position and the disengaged position is visible.

According to a tenth aspect, in some embodiments, said angular returning means and said axial returning means includes the same helical spring, configured to act in torsion and in compression. This spring can in particular be arranged around the post.

According to an eleventh aspect, in some embodiments, the first connector includes an axial abutment device, allowing limiting an axial movement of the post in the disassembly direction relative to the first body when the post is fastened to a body of the first connector before it is fastened to the second connector.

According to a twelfth aspect, in some embodiments, the axial abutment device includes a stop ring positioned around the post, and a shoulder formed on an inner surface of the guide passage, the stop ring coming into abutment against the shoulder when the post moves in the disassembly direction. The stop ring can for example be a split ring, positioned in a circumferential groove of the post.

According to a thirteenth aspect, in some embodiments, the connection assembly includes separating means configured to elastically separate the first connector relative to the second connector in the fastening direction, when the first connector and the second connector are connected to one another. These separating means allow positioning the retaining tab in abutment against the first shoulder when the post is in the fastening position.

These separating means can in particular include at least one separating slat, able to be placed between the first connector and the secondary connector.

According to a fourteenth aspect, in some embodiments, the external action includes an axial thrust moving the post in the fastening direction. In this case, the post can operate particularly according to the "push-latch" principle: to disconnect the post from the second connector it is necessary firstly to press it lightly in the fastening direction, to free it from the second connector; it is then possible to disengage it from the second connector, as well as the rest of the first connector, by moving it in translation in the disassembly direction (i.e. the direction opposite to the fastening direction).

Advantageously, according to the present disclosure the post passes from the fastening position to the free position simply by an action on the post itself. As this post passes through the second connector, this action can occur substantially along the axis of the post, and not on the sides of the connectors. Because of this, the disconnection of the post can occur in a reduced volume.

BRIEF DESCRIPTION OF THE DRAWINGS

FIG. 1 is a perspective view of a connection assembly prior to the connection of the two connectors to one another, in a first embodiment of the present disclosure.

FIG. 2 is a perspective exploded view of the connection assembly of FIG. 1.

FIG. 3 is a longitudinal section view of the connection assembly of FIG. 1, in the fastening position.

FIG. 4 is a first partial transverse section view of the connection assembly of FIG. 1, in the fastening position.

FIG. 5 is a second partial transverse section view of the connection assembly of FIG. 1, in the free position.

FIG. 6 is a partial perspective view of the connection assembly of FIG. 1, at the beginning of the operation of connecting the two connectors to one another.

FIG. 7 is a partial perspective view of the connection assembly of FIG. 1, during the operation of connecting the two connectors to one another.

FIG. 8 is a partial perspective view of the connection assembly of FIG. 1, at the end of the operation of connecting the two connectors to one another.

FIG. 9 is a partial perspective view of the connection assembly of FIG. 1, at the beginning of the operation of disconnecting the two connectors from one another.

FIG. 10 is a partial perspective view of the connection assembly of FIG. 1, during the operation of disconnecting the two connectors from one another.

FIG. 11 is a partial perspective view of the connection assembly of FIG. 1, at the end of the operation of disconnecting the two connectors from one another.

FIG. 12 is a partial perspective view of the connection assembly of FIG. 1, showing in particular the head of a post.

FIG. 13 is a lateral view of a spring of the connection assembly of FIG. 1, when it is compressed.

FIG. 14 is a lateral view of a spring of the connection assembly of FIG. 1, when it is extended.

FIG. 15 is a perspective view of a post of a connection assembly constituting a second embodiment of the present disclosure.

FIG. 16 is a partial perspective view of a connection assembly illustrating a third embodiment of the present disclosure.

FIG. 17 is a partial longitudinal section view of a connection assembly illustrating a fourth embodiment of the present disclosure.

FIG. 18 is a partial longitudinal section view of a connection assembly illustrating a fifth embodiment of the present disclosure.

DESCRIPTION OF EMBODIMENTS

A connection assembly 1 constituting an example of a first embodiment of the present disclosure will now be presented in relation with FIGS. 1 to 14.

The connection assembly 1 comprises a first connector 100 and a second connector 200. These connectors are configured to allow the connection of conductors designed for the communication of telecommunication signals or to transmit electrical current. Each of the connectors 100 and 200 can be fastened to a fixed support, particularly an electronic board such as a PCB, and/or be fastened to a telecommunication cable comprising a certain number of conductors allowing the transport of electrical signals and/or current(s)

The connector 100 is configured to be connected to the connector 200 by having it simply move in a fastening direction X+ (this disassembly direction X− being the opposite direction), until it reaches a final position, called the fastening position (the connector 200 remaining fixed). The side directed to the side indicated by the fastening direction X+ is called the "front side," while the opposite side is called the "back side."

In the embodiment proposed, the connection assembly 1 is symmetrical relative to a plane xOz (y=0 plane) containing the axis X. For this reason, the same numerical reference is attributed to the parts or portions of the connection assembly 1 positioned symmetrically on one side and on the other side of this plane of symmetry xOz, and only the half of the connector positioned on the same side of the plane xOz is described.

The connector 100 comprises a body 110 and two posts 120 (the connector 100 could comprise only a single post, or it could even comprise 3, 4, 5 or more). Although the posts could be formed integrally with the body 110, in this embodiment they are parts distinct from it.

A post 120 has a head 122 and a stem 124, which are both substantially cylindrical and coaxial. To assemble the first connector 100, the post is fastened to the body 110 of the first connector 100 by having the post 120 pass in a guide passage 112 provided in the body 110. The post 120 is configured to be introduced into the corresponding passage 112 following the fastening direction X+. It cannot however exceed a maximum displacement position, because the head 122 cannot penetrate into the passage 112 in its central section 114, which has a diameter smaller than that of the head 122.

A stop ring 130 is then fastened to the post 120, by clipping it (manufactured for this purpose in an appropriate elastic material) in a circumferential groove 128 of the post. The ring 130, which is a split ring, is introduced to the post from its front end 125. The guide passage 112 includes a circumferential abutment 116 at which, in the disassembly direction, its inner diameter passes from a value slightly greater than the outer diameter of the ring 130 to a value smaller than this diameter. Thus, the abutment 116 prevents the movement of the post 120 in the disassembly direction beyond a certain position in which the stop ring 130 is in abutment against the abutment 116. Thus, once the ring 130 is assembled on the post 120, it cannot be disassembled (except after having withdrawn the ring 130).

The connector 200 comprises a body 210 and a retaining part 220. The retaining part 220 has a retaining tab 222.

In the body 210, a fastening passage 212 is formed for each post 120. Each fastening passage 212 of the body 210 is arranged so as to be able to be positioned in front of a guide passage 112 of the body 110, and has an inner diameter substantially equal (ignoring clearance) to the outer diameter of the stem 124. Consequently, when the post 120 is in the fastening position, and a front part of the post 120 is engaged in the fastening passage 212, the guide 112 and fastening 212 passages are held facing one another coaxially by the post.

In addition, at its front end 125, which is positioned in the passage 212 when the post 120 is in the fastening position (FIG. 3), the post 120 has a circumferential surface 132. This surface 132 includes:

- in a first angular sector S1, a recessed surface 136 positioned between a first shoulder 138 on the front side, and a second shoulder on the back side; and
- in a second angular sector S2, a disassembly surface 134.

The recessed surface 136, between the first and second shoulders 138 and 139, forms a notch 137 in the circumferential surface 132.

The disassembly surface 134, in this embodiment, is a surface having a substantially constant transverse section (in a plane perpendicular to the axis X) regardless of the position in the fastening direction X+, from the axial position of the tab 222 (in the fastening position of the post) until the point of the post. In this embodiment, this transverse section forms an arc with radius R centered on the axis X.

As the transverse section of the disassembly surface is constant regardless of the position in the fastening direction X+, the disassembly surface 134 has no shoulder, no protrusion able to prevent the tab 222 from moving until the point of the post 120 by sliding on the surface 134.

The recessed surface 136, which is delimited in front by the first shoulder 138, is positioned radially recessed relative to this shoulder, i.e. it is positioned radially in a range of distances d from the axis X less than the radius R of the shoulder 138.

In this embodiment, the shoulder 138 has a cylindrical shape with the same radius R as the disassembly surface 134. It follows that the recessed surface 136 forms a recessed surface not only relative to the shoulder 138 by also relative to the disassembly surface 134.

The second connector is also equipped with the retaining part 220. Although this part can be formed integrally with the body 210 (as illustrated by FIG. 17), in the proposed embodiment this is a distinct part, rigidly fastened to the body 210. The part 220 is a part formed from a bent and cut metallic strip portion, and which has a large range of elastic deformation.

The body 210 and the part 220 are configured so as to allow the part 220 to be rigidly fastened to the body 210. This fastening can be provided by any appropriate means.

The tab 222 of the part 220 is inclined relative to the fastening direction, in such a manner that it is closer to the axis X as it is moved forward in the fastening direction X+. When the retaining part 220 and the post 120 are in the fastening position, the tab 222 is positioned in front of the fastening surface 136. The end of the tab is then supported both on this surface 136 and on the shoulder 138. As can be seen in FIG. 4, in this position, the retaining tab 222 is held in the same radial position (is at the same distance from the axis X) as the shoulder 138, and thus prevents the departure of the post 120 out of the passage 212.

The first connector 100 is also equipped with a spring 140. This spring 140 is a spring acting both in torsion and in compression, and is an example of the angular returning means and axial returning means (or angular biasing means and axial biasing means) within the meaning of the present disclosure.

In fact, the spring 140 is configured, when the post 120 is assembled in the passages 112 and 212, so as to turn the post 120 around its axis and thus return it into a certain position or angular range at least. This action serves to place the post 120 in the angular position called the "fastening angular position" in which, if the post 120 is engaged in the passages 112 and 212, the tab 222 will become supported on the recessed surface 136: this is the angular position shown in particular in FIGS. 3 and 4. As will be explained below, the post 120 is placed in the fastening angular position not only due to the spring 140, but due to the action of the spring 140 combined with the presence of angular abutments 142 and 144.

Conversely, FIG. 5 shows an angular position called the "free angular position" (or "disassembly angular position"), in which the tab 222 is not supported on the fastening surface 136 but on the contrary is supported on the disassembly surface 134.

During the connection of the first connector 100 to the second connector 200, the post is engaged in the passages 112 and 212. During this movement, to allow the tab 222 to be placed against the recessed surface 136, it is necessary that the post be in an angular position (the fastening angular position) which corresponds to the angular position of the retaining tab. To place the post in a certain manner in this desired angular position, as complement to the spring 140, the body 110 includes an abutment 142, and the head 122 of the post includes a corresponding abutment 144. These abutments are configured so as to block in rotation (relative to the axis of the guide passage) the post 120 in the desired angular position. Moreover, the body 110 and the head 122 of the post include abutments 146, 148 which prevent the post from turning by an excessive angle in the opposite direction of rotation. The head of the post 122 includes a hexagonal bore 150 by means of which it can be turned by means of an Allen wrench (any other head shape allowing driving the post in rotation around its axis would of course be practicable).

The spring 140 acts not only in torsion to hold the post 120 in the desired angular position for its fastening, but also in compression.

In fact, in the fastening position the spring 140 is compressed along the axis X of the post 120 (FIG. 3). Due to the fact that the post is prevented axially from moving in the disassembly direction (X−) by the retaining tab 222, the head of the post is located axially at the end of the body 110, and does not extend beyond the body 110 in the disassembly direction (i.e. does not extend on the side of the disassembly direction beyond the plane P of the end of the body 110).

Conversely, provided that the post is in the free position shown in FIG. 5, the post is pressed back by the spring 140 until the stop ring 130 is in abutment against the abutment 116 (the spring then acts as "axial returning means"). In this position, the head 122 of the post visibly extends beyond the body 110: this thus allows visually distinguishing the situation where the post is fastened in the assembly position (FIG. 13, the head 122 does not extend beyond the body 110), from the disassembly position (FIG. 14, the head 122 extends above the plane P delimiting the body 110).

Advantageously, when the connector 100 is not fastened to the connector 200, for each post 120 the spring 140 holds the post in a "ready to connect" position, because it then holds each of the posts in the fastening angular position. This "ready to connect" position allows rapid and secure, and in certain cases blind, locking of the connection. The end of the posts is conical to ensure the pre-guidance of the posts.

In addition to the tab 222, the retaining part plays a role of predetermined relative positioning of the first connector 100 relative to the second connector 200. To this end, the retaining part 220 includes two separating slats 224. These slats, which are elastic, are positioned substantially in a transverse plane (X=constant) relative to the axis of the post 120, but are however slightly inclined relative to this plane. The connectors 100 and 200 are configured in such a manner that in the fastening position these slats are sandwiched between the facing walls of the body 110 and the body 210. Consequently, due to their elasticity, these slats tend to separate from one another, in the assembly direction, the two bodies 110, 210. On the one hand, these separating forces cause the tab 222 to be supported against the shoulder 138 of the post 120; on the other hand, they guarantee that the lower surface 126 of the post head 122 is actually in abutment on the support surface 118 of the casing 110. Due to this, the possible clearance that could exist between the body 110 and the head 122 is taken up, and thus the connector 100 is fastened with no clearance to the connector 200 (the separating force, per retaining part 220, can for example be greater than 5 N) and does not risk disconnection even if there are vibrations.

The connection of the connectors 100 and 200 to one another is accomplished in the following manner:

Previously, the first connector 100 is assembled: each post 120 is placed in one of the passages 112 of the body 110 of the first connector and equipped with its stop ring 130.

S10) The connector 100 is positioned in front of the connector 200 in such a manner that the axes of the posts 120 are conflated with the axes of the fastening passages 212 in which they must be placed. (As before, the description which follows refers to a single post 120, but the remarks formulated for this post are applicable to all the posts).

S20) The connector 100 is brought closer to the connector 200 by moving it in the fastening direction X+. The post 120 is automatically placed in the fastening angular position, due to the return torque of the spring 140 and to the angular abutments 142, 144.

The end 125 of the post engages in the fastening passage 212. The tab 222, which is at this stage (FIG. 6) returned by elasticity into position in the fastening passage in front of the post 120 (along the axis X) is driven away radially outward by the end 125 of the post, which allows the post to continue its forward movement (FIG. 7).

Once the two connectors 100 and 200 are in contact (and the elastic slats 224 compressed) the forward movement of the first connector is stopped. At this time, the post heads 122 still extend beyond the back of the casing 110.

S30) To finalize the connection, the two post heads 122 are then pushed, manually or with a tool (alternately or simultaneously) until the lower surface 126 of the post head 122 is in contact with the support surface 118 of the casing 110. The connectors then reach the fastening position.

During this movement, when the post 120 reaches the fastening position, the tab 222 is no longer radially in front of the shoulder 138, but arrives in front of the recessed surface 136: it is then pressed against this surface with an audible noise. The spring 140 then returns toward the rear of the post 120, in such a manner that the tab 222 is pressed in abutment against the shoulder 138 (FIG. 8).

The elastic slats 224 are in compression between the two connectors 100 and 200 at this moment, and tend to separate the body 110 from the body 210. Under the influence of this pressure, the post 120 is returned rearward, which holds the end of the tab 222 firmly supported against the shoulder 138.

To disconnect the connector 100 from the connector 200, the following procedure is followed.

The connectors are initially in the fastening position (FIG. 8).

S120) The post 120 is turned around its axis X by means of an Allen wrench (FIGS. 9, 10). During this movement, the post passes from the fastening angular position (FIG. 4) into the free angular position (FIG. 5). The end of the tab 222 is progressively pushed back radially by the recessed surface 136 and passes into contact with the disassembly surface 134. In the latter position, the column 120 is no longer prevented from moving in the disassembly direction by the shoulder 138, and the first connector 100 can be moved rearward.

S130) While holding the post 120 in the free angular position (to avoid having it return into the fastening angular position under the influence of the return torque of the spring 140), the post is moved (relative to the first connector, or at the same time as it moves) in the disassembly direction, at least until the recessed surface 136 is no longer, axially, at the tab 222. The position thus attained is called the "disengaged position": this is the axial position of the post, positioned further rearward than the free position, in which the second connector (namely the tab 222) can no longer prevent the departure of the post 120 out of the passage 212, regardless of the angular position of the post.

S140) Finally, either by continuing to hold the post 120 in the free position, or by allowing it to return into the fastening angular position, the first connector 100 is move in the disassembly direction, which allows disconnecting it from the second connector 200.

To avoid the risk that the post, after having been placed in the free angular position (but before having reached the disengaged position), returns inadvertently to the fastening angular position (which would have the effect that the tab 222 would again press against the recessed surface and thus prevent the departure of the post), in certain embodiments means for blocking the post in rotation, once it has been placed in the free angular position, can be provided for.

Thus in certain embodiments, the disassembly surface 134 and the retaining tab can be configured in such a way that, once the post is placed in the free position (and can the move in the disassembly direction), the post is constrained to remain in a fixed angular position relative to its axis.

This blockage in rotation, which must not prevent the post from sliding relative to the second connector, can be accomplished in particular due to a cooperation of shapes between the retaining tab and the disassembly surface.

For example, the disassembly surface can include a guide groove such as the groove 135 shown in FIG. 16. The embodiment shown in this figure is identical to the first embodiment, except that the guide groove 135 is provided in the disassembly surface 134.

During the disconnection of the connector 100, in step S120), the post 120 is turned around its axis. The tab 222 is located (radially) in front of the disassembly surface 134. Consequently, the tab 222 is placed in the bottom of the groove 135 and consequently prevents the post 120 from turning around its own axis, this despite the return torque exerted by the spring 140. It follows that during step S130, the post can be extracted from the passage 212 without risking that the tab 222 interrupts this movement by blocking itself against the first shoulder 138.

Moreover, to facilitate the departure of the tab 222 out of the notch 137, it is possible to provide for the following additional step at the beginning of the disconnection procedure prior to step S120:

S110) the post 120 moves slightly in the fastening direction.

This step is carried out if the first connector is equipped so as to allow the post to advance in the fastening direction while the connectors are in the fastening position, as in the embodiment shown in FIG. 18.

In this embodiment, the connector 100 is configured in such a manner that the post 120 can move in the fastening direction in step 110, which is the first step of the disconnection procedure. This movement allows the shoulder 139 to push the tab 222 back and to cause it to depart from the notch 137. In step S120, the rotation of the post around its axis is thus facilitated.

Second Embodiment

A second embodiment will now be presented in relation with FIG. 15. This embodiment is identical to the first embodiment, with the exception of the following point. For simplicity, the same reference symbols are used for the first and the second embodiments.

In this second embodiment, the post 120 is arranged as in the first embodiment with the exception of its end. Consequently, the fastening passage 212 formed in the body 210 has a shape adapted to the specific shape that the post 120 has in this embodiment.

In this second embodiment, at the end 125 of the post 120, the disassembly surface 134 and the recessed surface 136 have the same radius R2, which is less than the radius R of the first shoulder 138.

The operation, and in particular the operations of connection and disconnection of the two connectors 100, 200 to one another are the same in this embodiment as in the first embodiment. However, when the post 120 is pivoted to allow it to pass from the fastening angular position to the free angular position, the recessed surface 136 does not have to radially push back the tab 222, due to the fact that the disassembly surface 134 and the recessed surface 136 are both surfaces with the same radius R2.

Although the present disclosure has been described by referring to specific exemplary embodiments, it is obvious that different modifications and changes can be performed on these examples without departing from the general scope of the disclosure as defined by the claims. Consequently, the description and the drawing can be considered in an illustrative, rather than a restrictive sense.

The invention claimed is:

1. A connection assembly including a first connector and a second connector, and wherein the first connector comprises a post having an axis;

a body of the second connector comprises a fastening passage for said post, and is arranged to allow the post to penetrate into said fastening passage by moving forward in a fastening direction, until it reaches a fastening position;

the first connector and the second connector are configured in such a manner that in the fastening position, the post is prevented by an abutment device from moving in a disassembly direction opposite to the fastening direction; and the first connector and the second connector are configured in such a manner that an external action applied solely to the post allows the post to pass from the fastening position to a free position, in which the post is disengaged from the abutment device and can move in translation in the disassembly direction;

wherein, in the fastening position, the post is in a predetermined angular range;

the connection assembly further comprises angular returning means configured to return the post into said predetermined angular range relative to the axis of the post, when the post is fastened to a body of the first connector before it is fastened to the second connector; and the post is rotatable relative to the body of the first connector.

2. The connection assembly according to claim 1, wherein the external action includes an application of a torque allowing, when the post is in the fastening position, to cause it to turn it around its axis, and thus to cause it to pass from a fastening angular position until a free angular position different from the fastening angular position.

3. The connection assembly according to claim 1, wherein one end of said post has a circumferential surface;

in a first angular sector, the circumferential surface has a recessed surface delimited in front in the fastening direction by a first shoulder, the recessed surface being positioned radially recessed relative to the first shoulder;

the abutment device includes a retaining tab secured axially to the second connector; and the first and the second connector are configured in such a manner that, when the post is in the fastening position, the retaining tab is positioned radially in front of the recessed surface, and is held in front of the first shoulder, viewed in the fastening direction.

4. The connection assembly according to claim 3, wherein, in a second angular sector, the circumferential surface has a disassembly surface having no shoulder in the fastening direction; and the first and the second connector are configured in such a manner that, when the post is in the free position, the retaining tab is positioned radially in front of the disassembly surface.

5. The connection assembly according to claim 3, wherein the retaining tab is formed integrally with the body of the second connector, or is a portion of a retaining part fastened to the body of the second connector, said retaining part preferably being a strip portion.

6. The connection assembly according to claim 3, comprising tab returning means, particularly elastic returning, configured to, in the absence of the post, hold the retaining tab in the fastening passage, at the same radial position as the shoulder of the post.

7. The connection assembly according to claim 6, the tab returning means of which is comprised of the retaining part, the retaining tab being formed integrally with the retaining part.

8. The connection assembly according to claim 1, the first connector of which comprises an angular abutment, and the post comprises an angular abutment, said angular abutments being configured to come into contact when the angular returning means return the post into said predetermined angular range.

9. The connection assembly according to claim 1, wherein the first connector includes axial returning means configured, when the post is in the free position, to move the post in the disassembly direction until a disengaged position in which the post, relative to a body of the first connector, is placed behind its axial position in the fastening position, and in which the second connector allows the departure of the post out of its fastening passage, regardless of the angular position of the post.

10. The connection assembly according to claim 9, in which said angular returning means and said axial returning means are comprised of the same helical spring, configured to act in torsion and in compression.

11. The connection assembly according to claim 1, wherein the first connector includes an axial abutment device, allowing limiting of an axial movement of the post relative to a body of the first connector in the disassembly direction when the post is placed in a guide passage of said body of the first connector.

12. The connection assembly according to claim 11, wherein the axial abutment device includes a stop ring positioned around the post, and a shoulder formed on an inner surface of the guide passage, the stop ring coming into abutment against the shoulder when the post moves in the disassembly direction.

13. The connection assembly according to claim 1, including separating means configured to elastically separate the first connector relative to the second connector in the fastening direction when the first connector and the second connector are connected to one another.

14. The connection assembly according to claim 1, in which the external action includes an axial thrust moving the post in the fastening direction.

* * * * *